United States Patent [19]

Arzouman et al.

[11] Patent Number: 4,960,264

[45] Date of Patent: Oct. 2, 1990

[54] ALIGNMENT AND RELEASE MECHANISM FOR TWO-PART JACK SYSTEM

[75] Inventors: Harry H. Arzouman, Corona Del Mar; Clyde E. Slay, Santa Ana, both of Calif.

[73] Assignee: Safe-T-Jack, Inc., Huntington Beach, Calif.

[21] Appl. No.: 350,111

[22] Filed: May 9, 1989

[51] Int. Cl.[5] ..... B66F 5/04

[52] U.S. Cl. ..... 254/8 B; 254/89 R

[58] Field of Search ..... 254/133 R, 134, 8 B, 254/8 R, 89 R, 1, DIG. 1; 298/354 P, 354 S; 414/427; 403/326, 328, 330

[56] References Cited

U.S. PATENT DOCUMENTS

| | | | |
|---|---|---|---|
| 2,624,543 | 1/1953 | Jackson | 254/8 B |
| 4,241,899 | 12/1980 | Kaneko | 254/8 B |
| 4,251,056 | 2/1981 | Maniglia | 254/8 B |
| 4,289,299 | 9/1981 | Kameda | 254/8 B |
| 4,462,569 | 7/1984 | Arzouman | 254/8 B |

*Primary Examiner*—Robert C. Watson
*Attorney, Agent, or Firm*—Gene W. Arant

[57] ABSTRACT

A two-part jack system includes a mechanical jack stand with a ratchet mechanism and a ratchet release, and a power unit that may be selectively aligned with and attached to the jack stand for raising or lowering it. A unitary control mechanism carried by the power unit is adapted to selectively lock the power unit in an aligned position relative to the jack stand, and also to selectively release the ratchet release of the jack stand. A locking mechanism is carried in part by the jack stand and in part by the power unit. The unitary control mechanism has three different operating positions. In one operating position the locking mechanism is kept locked while the ratchet release is left in an unreleased state; in a second operating position the locking mechanism is kept locked while the ratchet release is released; and in the third operating position the locking mechanism is held in an unlocked condition while the ratchet release is left in an unreleased state. The power unit has an operating handle, and a single lever which operates the unitary control mechanism is carried on the power unit operating handle for convenient access and easy control by a human operator.

5 Claims, 7 Drawing Sheets

Fig. 2.
Fig. 1.
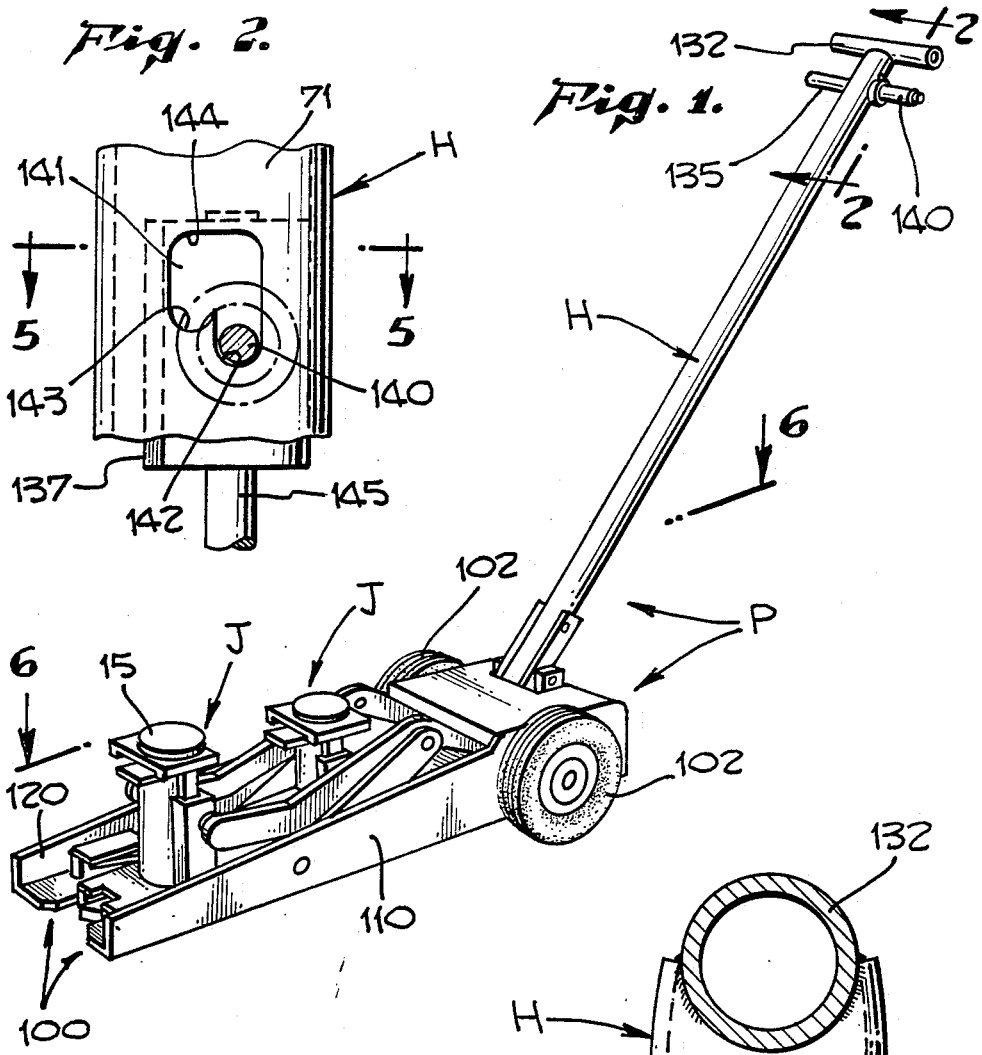
Fig. 3.
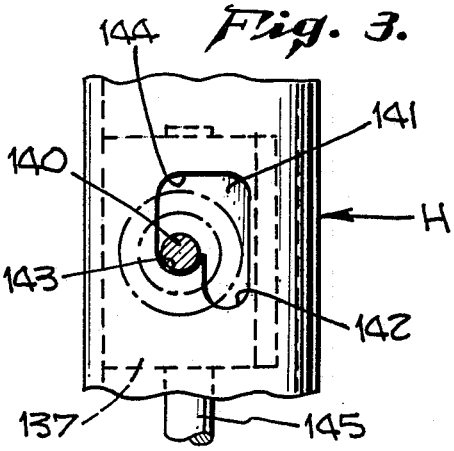
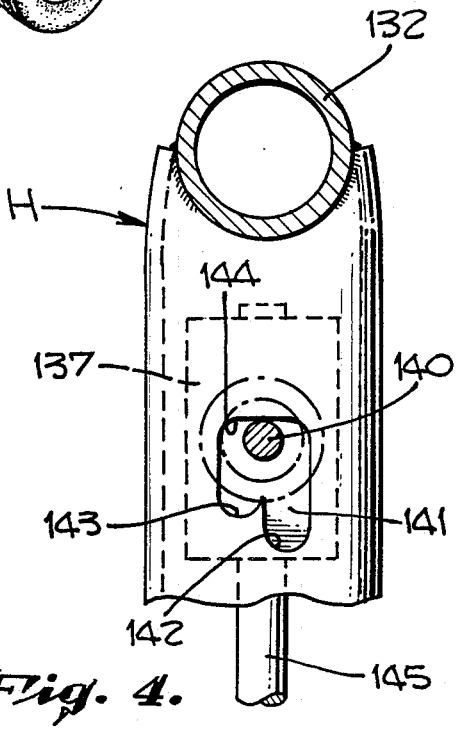
Fig. 4.

15
14
16
J
22
12
20
32
26
120
P
65
67
44
48
175
40
42
10
60
15
140
141
145
137
H

ALIGNMENT AND RELEASE MECHANISM FOR TWO-PART JACK SYSTEM

RELATED PRIOR PATENTS

The present invention is an improvement over the inventions disclosed in the seven issued United States patents of Harry H. Arzouman, the principal inventor of the present invention, and in particular the inventions disclosed in U.S. Pat. No. 4,462,569 issued Jul. 31, 1984 (later reissued as Re. No. 32,715), and U.S. Pat. No. 4,697,788 issued Oct. 6, 1987.

BACKGROUND OF THE INVENTION

Each of the referenced prior patents discloses a two-part jack system which includes a mechanical jack stand that is raised or lowered by a detachable power unit. In the particular system shown in U.S. Pat. No. 4,462,569, the power unit is also utilized for transporting two or more jack stands. In a system of that type the cooperation required between the two units of the system has many different aspects, including:

(1) Picking up a jack stand for purpose of transport.
(2) Transporting a jack stand and positioning it where needed.
(3) After the jack stand is positioned, utilizing it to raise a load.
(4) Detaching the power unit from the raised, loaded jack stand without disturbing the load.
(5) Moving a second jack stand, already carried by the power unit, into a position of readiness for use.
(6) Re-attaching the power unit to a raised, loaded jack stand.
(7) Operating the power unit to lower a raised, loaded jack stand in a safe manner.
(8) Transporting a lowered, unloaded jack stand to a different location.

As shown in each of the referenced previous patents, the mechanical jack stand includes a pair of telescoping vertical frame members, and the lower and stationary frame member carries a spring-loaded pawl while the upper and raisable frame member carries a series of ratchet teeth adapted to be engaged by the pawl. The pawl has a downwardly extending release arm whose lower extremity may be thrust or pivoted towards the frame members for disengaging the pawl from a particular ratchet tooth with which it is then engaged.

When the jack stand is under load, the vertical load on the ratchet tooth and pawl prevents the pawl arm from being easily disengaged. In accomplishing step (7), above, it is therefore desirable, and in fact usually necessary, to first operate the power unit for lifting the load, at least momentarily, so that the pawl can be disengaged. While that lifting action is being maintained, an inward thrust is then applied to the lower extremity of the pawl release arm for releasing the pawl.

As disclosed in U.S. Pat. No. 4,697,788, the inward thrust is preferably applied by a ratchet release member (such as a spring-loaded pusher) whose operation is normally restrained except when the jack stand is to be lowered. Removal of the restraint then permits the spring-loaded pawl to disengage from the ratchet tooth as soon as the vertical load is lifted from the tooth.

SUMMARY OF THE PRESENT INVENTION

The present invention provides an improvement in that type of two-part jack system which includes a mechanical jack stand with a ratchet mechanism and a ratchet release, and a power unit that may be selectively aligned with and attached to the jack stand for raising or lowering it. According to the invention a unitary control mechanism carried by the power unit is adapted to selectively lock the power unit in an aligned position relative to the jack stand, and also to selectively release the ratchet release of the jack stand.

Further according to the invention, a locking mechanism is carried in part by the jack stand and in part by the power unit, and the unitary control mechanism, has three different operating positions. In one operating position the locking mechanism is kept locked while the ratchet release is left in an unreleased state. In a second operating position the locking mechanism is kept locked while the ratchet release is released. And in the third operating position the locking mechanism is held in an unlocked condition while the ratchet release is left in an unreleased state.

An additional feature of the invention is that the power unit has an operating handle, and a single lever which operates the unitary control mechanism is carried on the power unit operating handle for convenient access and easy control by a human operator.

Another feature of the invention is the novel method of operation.

As a further and separate invention, the present application also discloses and claims a novel method and apparatus for transporting and manipulating multiple jack stands with a single power unit.

DRAWING SUMMARY

FIG. 1 is a perspective view of the power unit when it is loaded jack stands ready to be transported;

FIG. 2 is a fragmentary elevational view of the handle of the power unit, taken on line 2—2 of FIG. 1;

FIG. 3 is a view like FIG. 2 but showing a different position of the control lever;

FIG. 4 is a view like FIG. 2, showing a third position of the control lever, and also showing the hand grip of the handle in cross section;

DETAILED DESCRIPTION OF THE PREFERRED EMBODIMENT

(Drawing FIGS. 1 through 17)

Figures 5, 14:
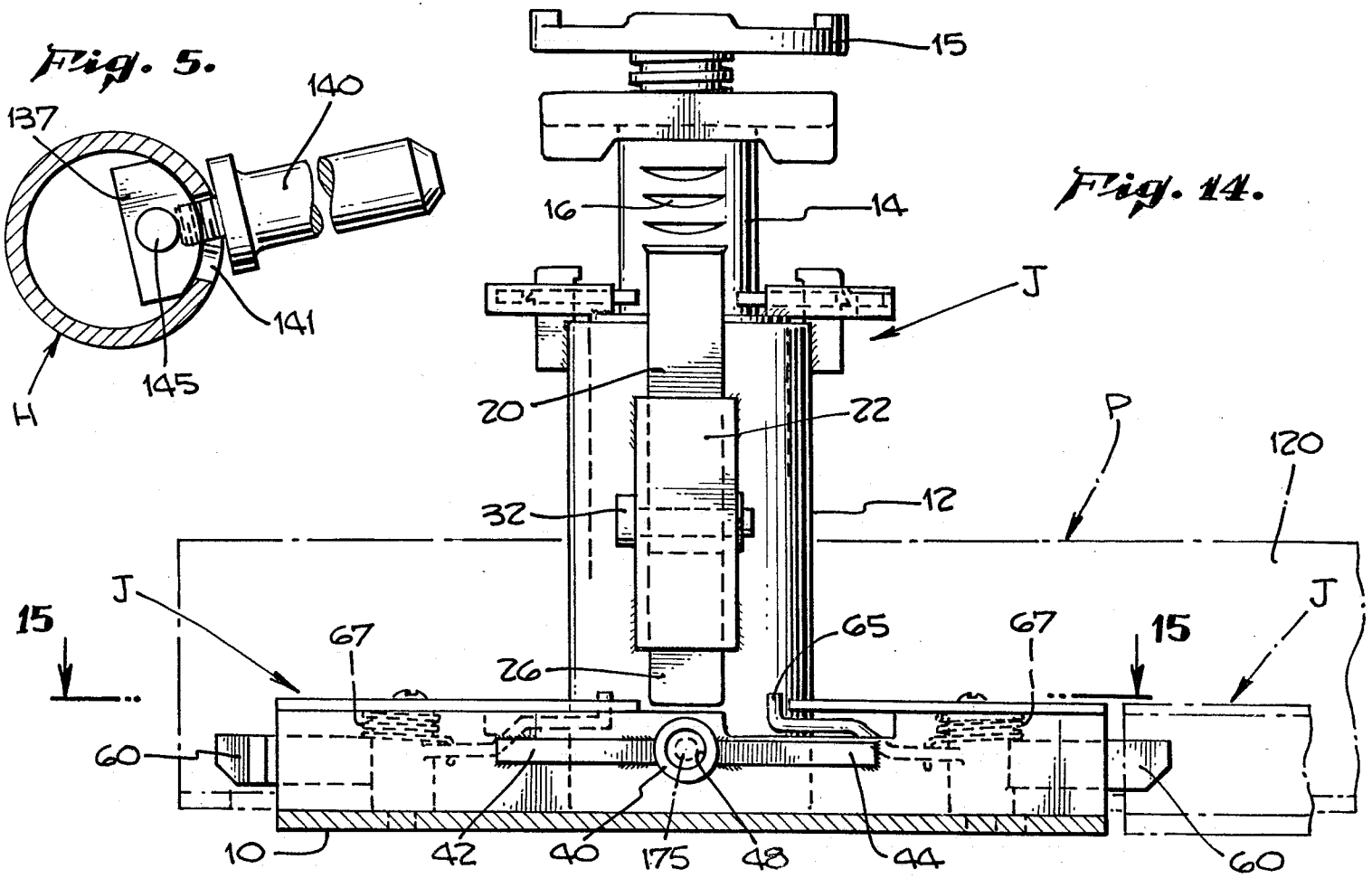
FIG. 5 is a cross-sectional view of the handle and control lever taken on the line 5—5 of FIG. 2.
FIG. 14 is an elevation view taken on the line 14—14 of FIG. 8, partially in cross-section, particularly showing one of the side rails of the jack stand which is instrumental in aligning the power unit with the jack stand and locking them in their interengaged relationship, and also showing in dotted lines a second jack stand carried by the power unit and first jack stand.

Referring now to the drawings, the jack stand J will first be described in some detail; the power unit P will then be described in some detail; and thereafter the structure and operation of the cooperating portions of the two units will be described in even greater detail.

THE JACK STAND

Figure 8:
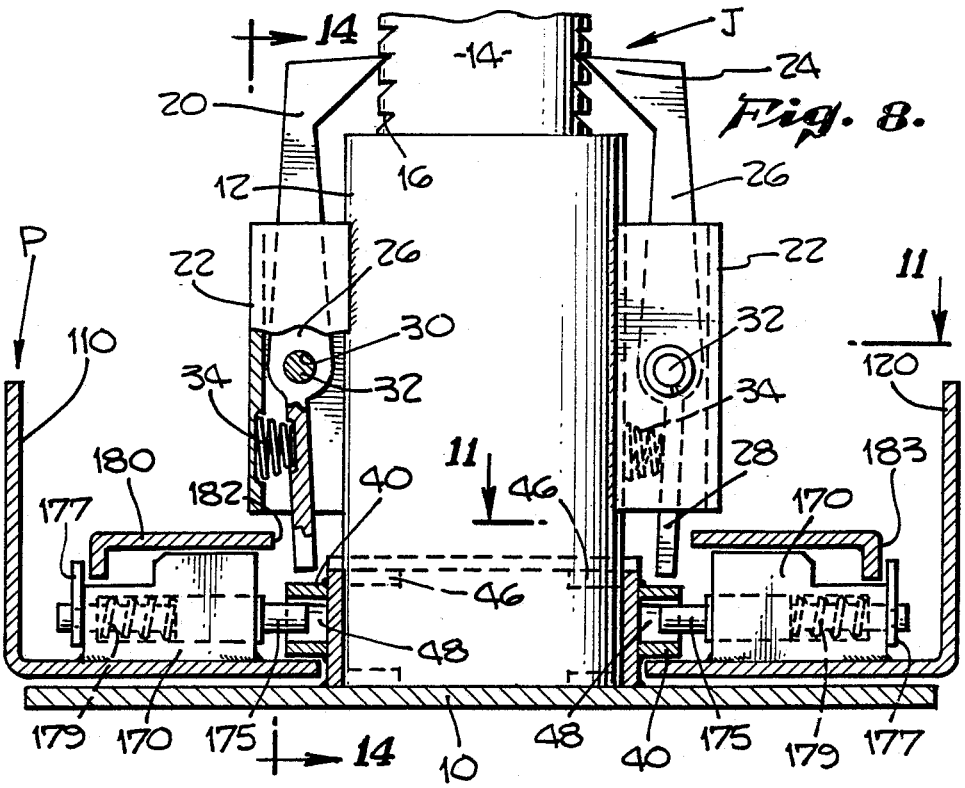
FIG. 8 is a cross-sectional elevation view taken on the line 8—8 of FIG. 6, showing both the jack stand and the power unit in full lines, and showing a first position of their interengaging control mechanisms.

The jack stand J is generally similar to the one shown in U.S. Pat. No. 4,697,788. It includes a flat base plate 10, a lower frame member 12 which is hollow, and an upper frame member or shaft 14 which moves telescopically and vertically inside the lower frame member. The lowermost end of the lower frame member 12 is secured to the base plate 10 as by welding, and the base plate extends laterally outward by some distance from at least two sides of the lower frame member. A load-bearing seat 15 is carried at the upper end of upper frame member 14 (FIG. 14). Jack stand J has two opposite sides which for the most part are symmetrical in their arrangement and operation, hence only in FIGS. 8, 15, and 16 are both sides of the jack stand shown.

The upper frame member or shaft 14 has ratchet teeth 16 formed thereon. A dog or pawl 20 is pivotally supported from the lower frame member 12 and is adapted to engage with the ratchet teeth. An auxiliary housing 22 of generally U-shaped cross-sectional configuration having two parallel side walls and one outer wall is attached to one side of the lower frame member 12 for enclosing all but the lowermost extremity of the dog or pawl. The pawl 20 has a tooth portion 24 on its upper end, a downwardly extending pawl arm 26 whose lowermost portion provides a ratchet release arm 28, and a transversely extending hole 30 somewhat below its vertical center which receives a pivot pin 32. The ends of the pivot pin 32 are secured to the respective parallel side walls of auxiliary housing 22. A compression spring 34 has one of its ends seated against the outer vertical wall surface of lower frame member 12 while its other end is seated against the inner surface of release arm 28; the location of the spring being above the lowermost extremity of the auxiliary housing 22 so that it is fully enclosed thereby, but sufficiently far below the hole 30 and pivot pin 32 so that it affirmatively pushes the tooth portion 24 of the pawl into engagement with one of the ratchet teeth 16.

Figure 11:
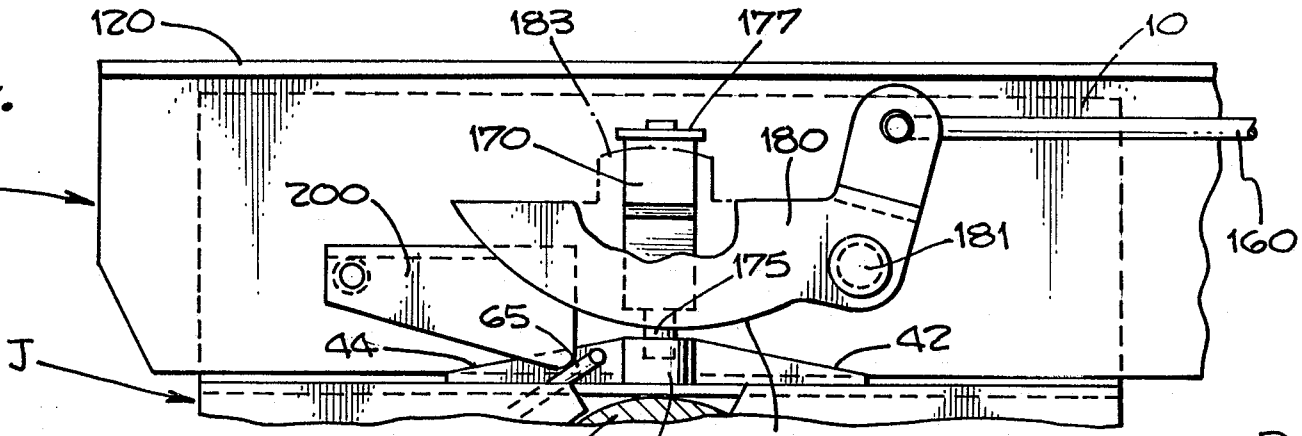
FIG. 11 is a cross-sectional plan view of the right-hand side of the power unit and jack stand of FIG. 8, taken on the line 11—11 of FIG. 8, and showing the first position of the control mechanisms as seen from above.
Figure 15:
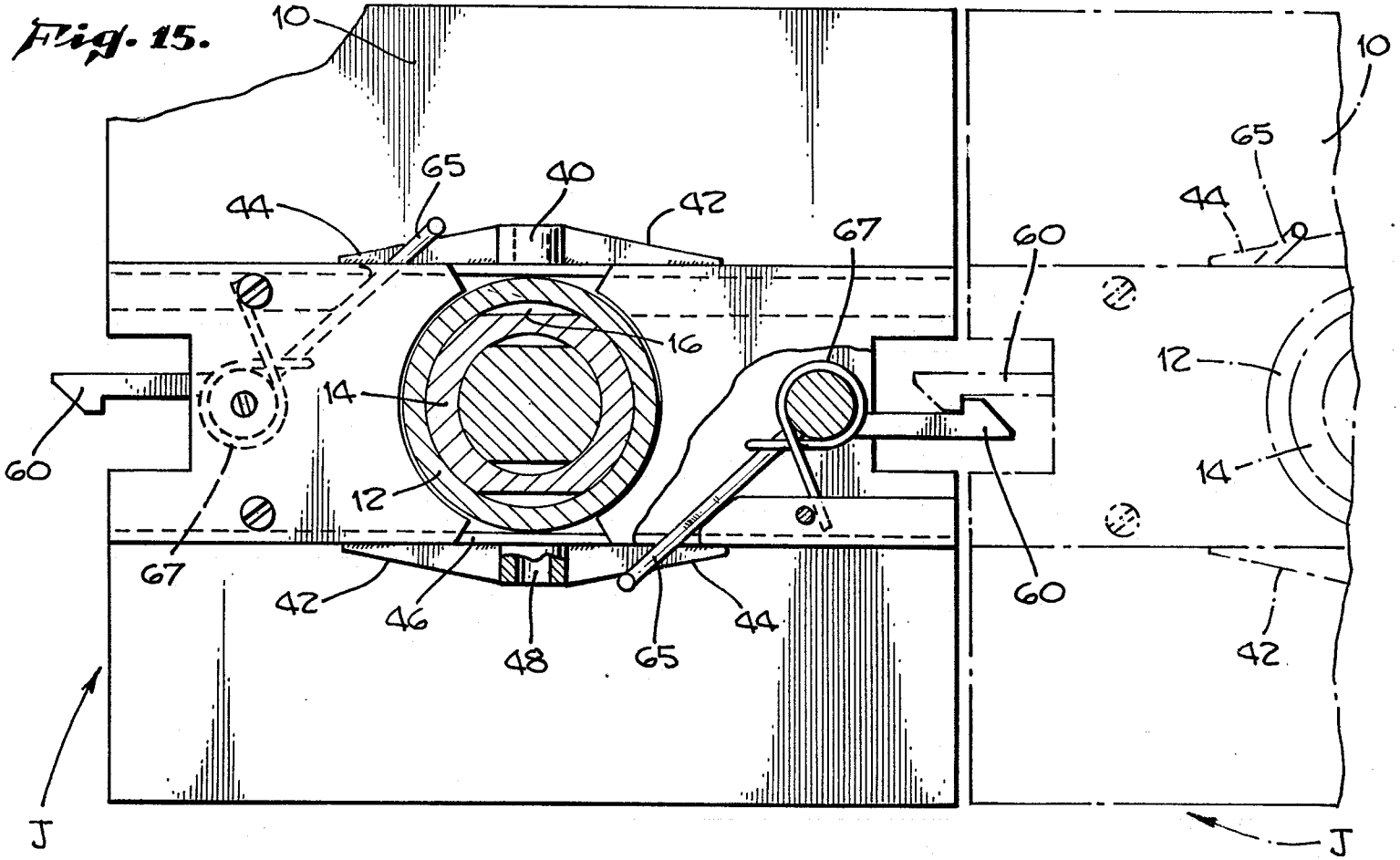
FIG. 15 is a plan view taken on line 15—15 of FIG. 14, showing part of the first jack stand in cross-section, parts of the power unit broken away, and also showing in dotted lines the interlatched portion of the second jack stand.
Figure 16:
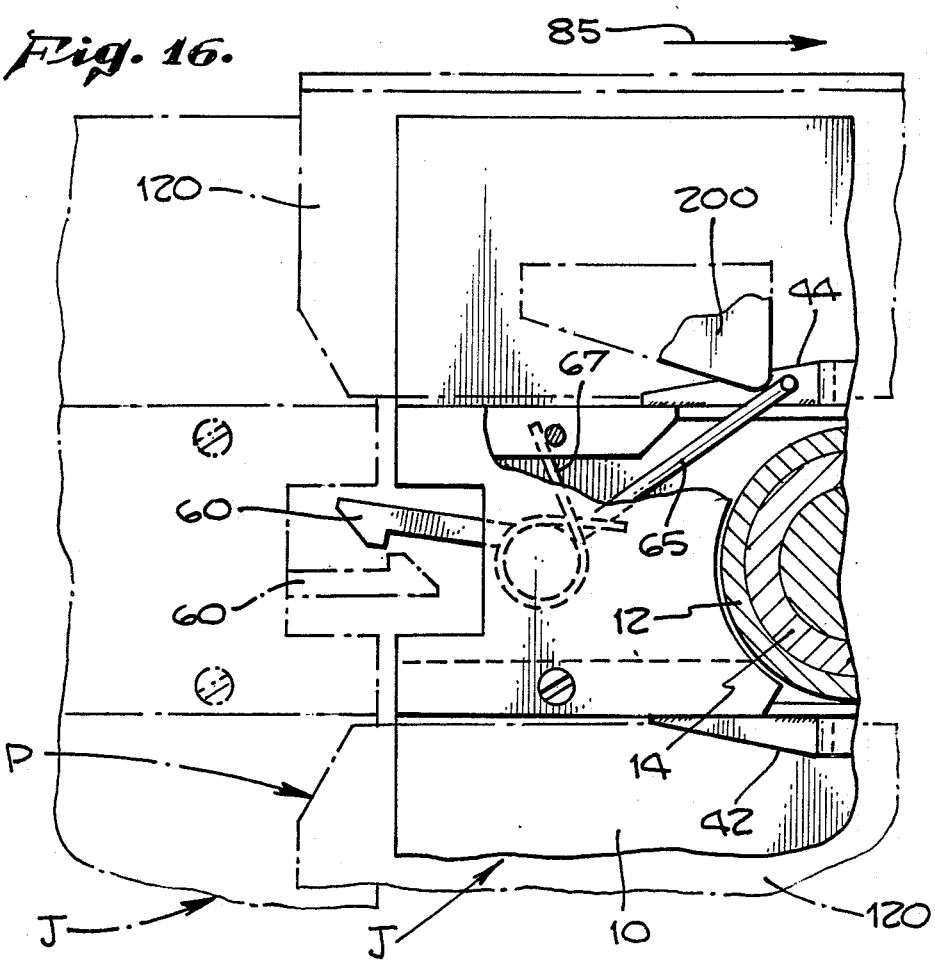
FIG. 16 is a plan view similar to FIG. 15 and illustrating the action of the mechanisms which automatically unlatch the two jack stands from each other.

As a novel feature of the present invention, jack stand J also has a side rail 40 with sloped ends 42, 44 providing ramps, which are best seen in FIGS. 11 and 15. The rail 40 is supported from the wall of the frame member 12 by means of a U-shaped boss 46 whose ends are secured in respective openings in the side wall of the frame. The length of rail 40 in a horizontal plane is considerably greater than the horizontal dimension of the frame member wall 12 measured lengthwise of the power unit P, as best seen in FIG. 14. A horizontal hole or alignment opening 48 is formed in the side rail 40 at its longitudinal center. The purpose of the side rail 40 is to facilitate the alignment of the power unit with the jack stand, and the purpose of alignment hole 48 is to permit the power unit to first be aligned with the jack stand, and then secured in its aligned position.

Some additional parts of the jack stand structure which are utilized in latching two or more jack stands into a longitudinal series will be described subsequently in conjunction with FIGS. 6, 7, and 14 through 17.

THE POWER UNIT

Power unit P is generally similar to the power unit shown in U.S. Pat. No. 4,462,569. It has a generally box-like frame or shoe 100 which is supported on a pair of wheels 102 attached on its sides near its rearward end. The frame or shoe has left and right extensions 110, 120, which extend forward from its respective sides, providing a generally U-shaped configuration in the horizontal plane, as best seen in FIG. 8. Power unit P also includes a scissors lifting mechanism S having a pair of forward lifting arms 130, which normally rest within the shoe extensions 110, 120, but may be raised for directly engaging the load-bearing seat 15 at the top of the jack unit and thereby lifting the load which the seat supports. In the present illustrations, the jack stand is provided with an extensible upper mechanism, which is expected to be the subject of a separate application for patent. However, the general idea is the same as that shown in the previous Arzouman patents, namely, that the scissors arms directly lift the load-bearing seat and hence its load.

An operating handle H extends rearwardly and upwardly from the power unit main frame or shoe 100, as best seen in FIG. 1. The operating handle is used in conventional fashion to wheel the power unit about on its wheels 102; to be pumped up and down for providing energy to a hydraulic cylinder C, shown schematically in FIGS. 6 and 7, which in turn raises the scissors S; and also to control the interengagement between and the cooperative action of the power unit P and the jack stand J.

A hand grip member 132 is transversely attached to the uppermost end of handle H. On the right-hand side of the power unit as it is viewed from the rear of the machine there is a cylinder release lever 135, shown only in FIG. 1. Release lever 135 performs the usual function of releasing hydraulic pressure inside the hydraulic cylinder when that pressure is no longer needed. The release lever may be coupled to the hydraulic cylinder in any suitable manner, not shown in the present drawings. Insofar as the foregoing features are concerned, power unit P is not significantly different from that shown in U.S. Pat. No. 4,462,569. However, the present power unit has other features which differ very significantly from those shown in the previous Arzouman patents.

NOVEL FEATURES OF THE POWER UNIT

Specifically, on the left-hand side of handle H as viewed from the rear of the machine there is an operations control lever 140. Operations control lever 140 controls the modes of interengagement of control devices carried by the power unit with the jack stand. Both of the levers 135 and 140 are parallel to and conveniently adjacent to hand grip member 132.

Figure 9:
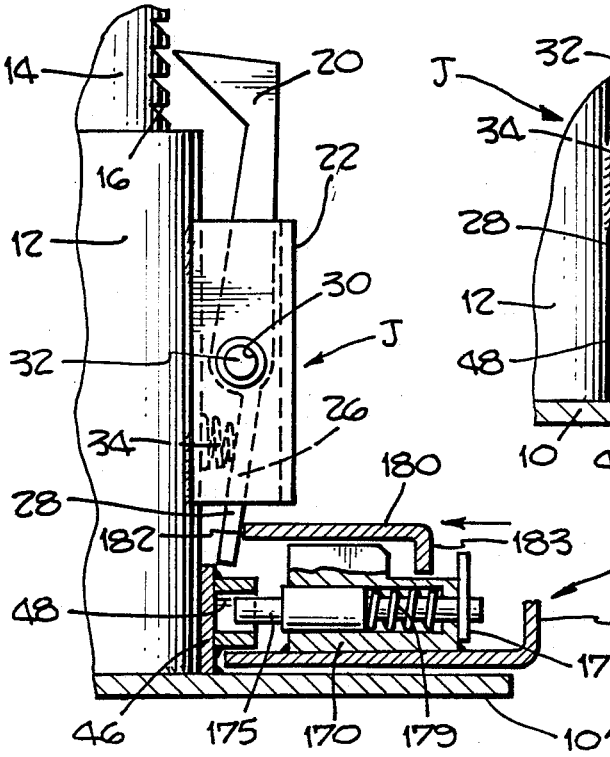
FIG. 9 is a view similar to the right-hand portion of FIG. 8, but showing a second position of the controls.
Figure 10:
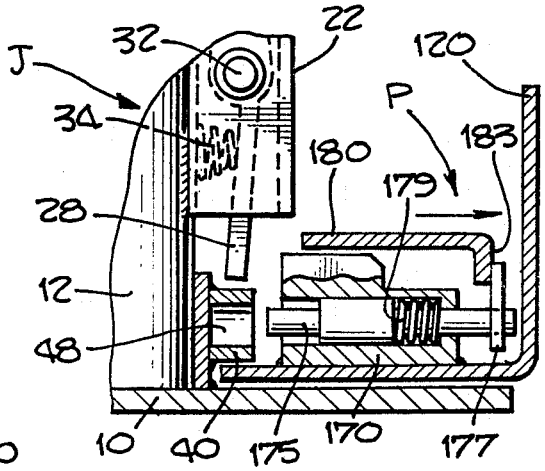
FIG. 10 is a view similar to the right-hand portion of FIG. 8, but showing a third position of the controls.
Figure 13:
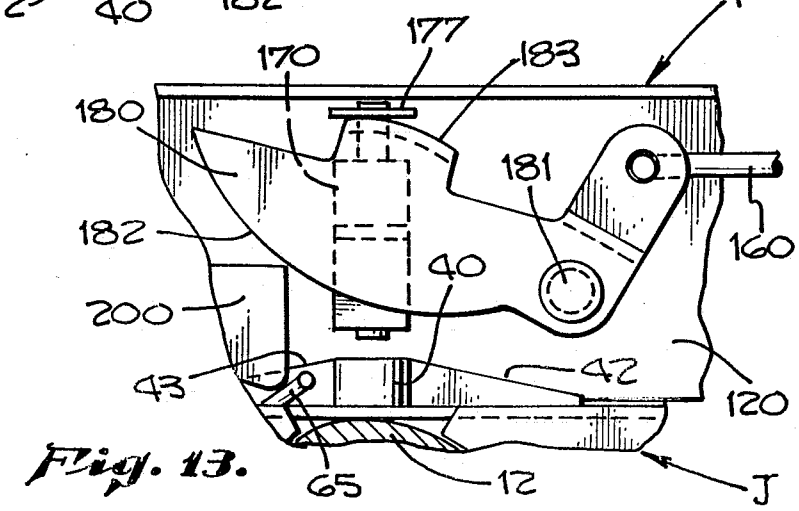
FIG. 13 is a view similar to FIG. 11, showing the third position of the controls as seen from above.
Figure 12:
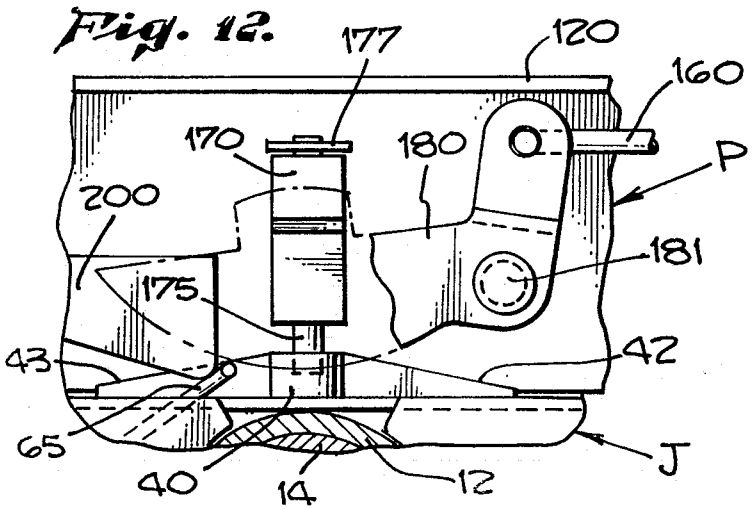
FIG. 12 is a view similar to FIG. 11, showing the second position of the controls as seen from above.

The functions of operations control lever 140 are particularly illustrated in FIGS. 2–4 which show three different lever positions, FIGS. 8–10 which show elevation views of the control devices in those three positions, and FIGS. 11–13 which show plan views of the control devices in those same three positions.

Inside the handle H there is a control rod 145 which extends all the way from operations control lever 140 to the bottom end of the handle. A special attachment member 137 (FIG. 5) attaches the upper end of control rod 145 to the inner end of control lever 140. At the lower end of handle H, and within the rearward end portion of frame 100 of the power unit, a transversely extending torsion or actuator tube 150 (FIGS. 6 and 7) serves to transmit control information from the control lever 140 to the forward end of the power unit. More specifically, actuator tube 150 is supported on a transverse rod 152 whose ends are fixedly secured in corresponding side walls of the rearward end of frame 100. An actuator arm 147 acts as a lever, having one end rigidly attached to torsion tube 150 at the horizontal center thereof, while its otherwise free end is hookingly engaged by the lower end of control rod 145.

Also rigidly attached to torsion tube 150, but near its lateral ends, are a pair of pull arms 155 which also act as levers. Each of the pull arms has one end fixedly attached to the torsion tube 150 and an outer and otherwise free end which is attached to the rearward end of an operating rod 160. More specifically, each operating rod 160 has its rearward end bent at a right angle and extending through an eye or opening in the lower end of the associated pull arm 155, and thence inwardly of the frame 100 of power unit P. On the inner part of the rearward end of each rod 160 a spring 158 is attached, and the forward end of each spring is secured by a hook to the bottom of frame 100 (see FIG. 6). Springs 158 tend to pull the control rod 145 downward, away from hand grip 132.

Operating rod 160 controls the interengagement of the associated control mechanisms with the corresponding side of the jack stand J. Because of the springs 158 each operating rod 160 is normally urged toward the forward end of the power unit, i.e., toward the forward end of the corresponding shoe extension 110 or 120.

THE CONTROL MECHANISMS

A portion of the control mechanisms has already been described as part of jack stand J. Thus, ratchet release arm 28 (the lower end portion of pawl arm 26) stands ready to release the toothed end 24 of the corresponding pawl from the particular ratchet tooth 16 with which it is then engaged (assuming that there is no vertical load on the jack stand sufficient to prevent this action from taking place). Side rails 40 with their sloped end ramps 42, 44, will assist in the lateral alignment of the power unit relative to the jack stand, whenever the power unit is moved along its own longitudinal axis relative to the jack stand. And alignment hole 48, located in the longitudinal center of side rail 40, is available to assist in providing a locking action whenever a position of alignment has been reached.

In the power unit P, each forward extension 110, 120 of the shoe has a generally L-shaped vertical cross-sectional configuration, thus including both an inner horizontal part and an outer vertical part (FIG. 8). An alignment pin block 170 is attached to the horizontal portion of each forward extension (see FIGS. 7–10). An alignment pin 175 is supported within the corresponding pin block, extending horizontally in a direction transverse to the longitudinal axis of the power unit frame 100. A pin tab 177 is attached to the outermost end of pin 175 somewhat near to but nevertheless spaced away from the vertical wall of the associated shoe extension, and a pin spring 179 housed inside the pin block urges the alignment pin in a forward direction, i.e., towards the lateral center of the frame 100. The movements of the alignment pin 175, in a direction towards or away from the lateral center of frame 100, are controlled by the action of the control rod 145, through the operating rod 160 and flipper 180, as will now be described.

Also included in the power unit are a pair of flipper members, alternatively known as ratchet release members, identified by numeral 180. Each flipper is pivotally mounted upon a fixed vertical pin or post 181 (FIGS. 11–13) that rises up from the horizontal portion of the frame extension 110 or 120. Each flipper 180 is also pivotally coupled, at one of its corners, directly to the associated operating rod 160. The corresponding end of the flipper 180 acts as a lever arm, the movements of the operating rod control the movements of the flipper, and the movements of the flipper in turn control the movements of both the associated alignment pin 175 and the associated ratchet release arm 28.

More specifically, each flipper 180 has an inner edge 182 which selectively engages the associated ratchet release arm 28. On its outer edge the flipper has a downwardly extending tab 183 which fits inside the pin tab 177 of the associated alignment pin 175. When the flipper is moved horizontally to its extreme inward position it pushes ratchet release arm 28 inward, and at the same time alignment pin 175 is free to be urged into its innermost position by its spring 179. When the flipper is moved horizontally towards its extreme outward position it first disengages from the ratchet release arm 28, and subsequently forces the pin tab 177 toward the outer wall of the associated shoe extension 110 or 120, thereby withdrawing the alignment pin 175 against the force of its spring 179 towards the interior of the pin block 170.

CONTROLLING THE ENGAGEMENT, ALIGNMENT, AND LOCKING OF THE POWER UNIT TO THE JACK STAND

Figure 17:
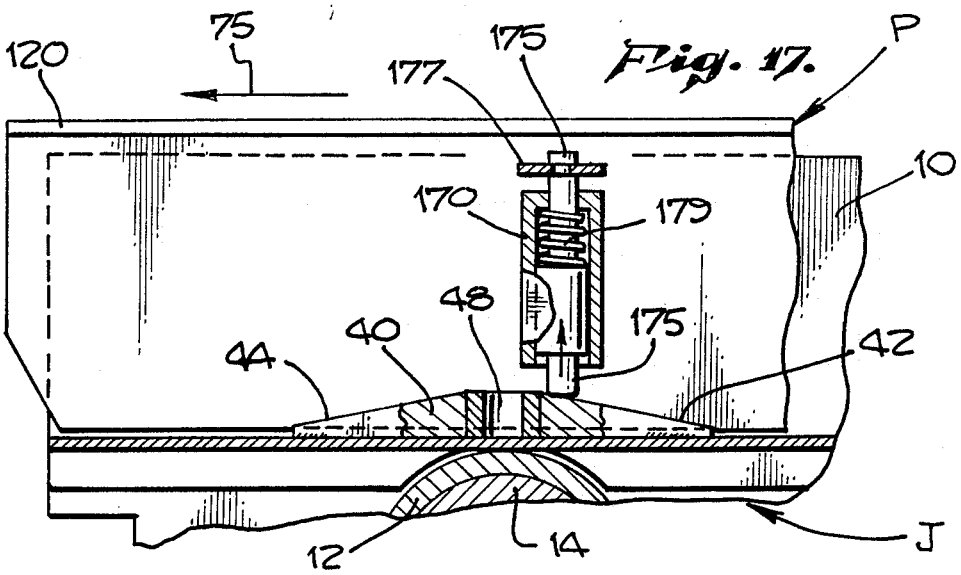
FIG. 17 a fragmentary plan view of one side of a jack stand and one side of the power unit, showing how the locking pin on the power unit rides up a ramp on the side rail of the jack stand before reaching and falling into the alignment hole.

When power unit P is used to pick up a jack stand J, the shoe extensions 110, 120 slide over the respective side portions of bottom plate 10 of the jack stand and underneath the respective side rails 40 (see FIG. 8). Lateral alignment of the two parts of the apparatus is assisted by alignment pins 175 riding up the ramps 42 or 44 of the corresponding side rails 40 of the jack stand J (see FIG. 17). In FIG. 17 the arrow 75 indicates the direction of movement of power unit P relative to jack stand J. When each alignment pin 175 reaches the location of the alignment hole 48, it is forced into the hole by it compression spring 179. This mechanism controls, rather easily and precisely, the alignment and locking of the power unit to the jack stand. In accomplishing this operation it is not necessary for a human operator to directly touch the involved parts of the mechanism—the handle H is simply used to guide the movement of the power unit upon its wheels, and the alignment pins, alignment pin springs, side rails, side rail ramps, and alignment holes, accomplish the remainder of the function.

REMOTE CONTROL OF THE JACK STAND AFTER THE POWER UNIT HAS BEEN LOCKED TO IT

After the power unit has been locked to the jack stand springs 158 (FIGS. 6 and 7) tend to keep the operating rods 160 in their most forward position. Whether that actually happens depends upon the position of the control lever 140 (see FIGS. 2–4). Lever 140 extends through an opening 141 in the side of handle H, the opening being somewhat L-shaped in that it has a lowermost corner 142, another separate but less low corner 143, and an upper end edge 144. If lever 140 is permitted by the operator to drop into the lowermost corner 142 (FIG. 2), then operating rods 160 do indeed assume their most forward positions, and the positions of the control mechanisms 175 (alignment pin) and 180 (flipper) are as shown in FIGS. 9 and 12. That is, the alignment pin occupies the alignment hole and the edge 182 of flipper 180 holds the ratchet release arm 28 in its inward position. In this position, toothed portions 24 of pawls 20 cannot engage ratchet teeth 16 of the jack shafts 14, and it will still be possible to use the power unit through cylinder C and scissors S to raise the load-bearing seat 15, but the ratchet mechanism for keeping the load in a raised position will be inoperative.

When control lever 140 is pulled back toward hand grip 132 by the operator and then permitted to rest in the corner 143 of opening 141 (FIG. 3) a different condition prevails. Specifically, the positions of the control mechanisms 175 and 180 are as shown in FIGS. 8 and 11. That is, locking pins 175 still lock the power unit to the jack stand, but the flippers have released the ratchet release arms 28, and thus the ratchet mechanisms are permitted to operate. In this condition, handle H may be pumped up and down to provide energy to cylinder C, and scissors S will raise the arms 130 for lifting the load-bearing seat 15. The ratchet mechanism will then hold up the load, in whatever position of elevation it has achieved, when the lifting arms 130 are lowered or removed.

DISENGAGEMENT OF THE POWER UNIT

The third position of control lever 140 is used to release the power unit from the jack stand. The operator pulls the lever to its uppermost position in contact with the upper edge 144 of opening 141 (FIG. 4). The situation then is as shown in FIGS. 10 and 13. That is, the alignment pins are withdrawn from the alignment holes of the side rails of the jack stand, and the flippers are withdrawn from engagement with the ratchet release arms. It is then possible to pull or push the power unit in a longitudinal direction for disengaging it from the jack stand.

LIFTING THE LOAD; LOWERING THE LOAD WITH AUTOMATIC RELEASE

In order to lift a load with the jack stand J the power unit is aligned with and locked to the jack stand. Normally, the power unit will first have been used to pick up the jack stand from a previous location and transport it to a new location where it is to be used.

When the jack stand is in its proper location with base plate 10 securely resting upon the floor or ground or other supporting surface, and the power unit is locked to the stand, a lifting action can then be accomplished. The operator puts operations control lever 140 in its second position in notch 143 of opening 141 of handle H. Then the operator pumps the handle up and down in order to energize the hydraulic cylinder and cause it to raise the lift arms 130 which directly lift the load. At the same time, pawl 20 is free to push its tooth 24 inwardly under the force of spring 34, so that as the shaft or upper frame member 14 of the jack stand moves upwardly the tooth 24 engages successive ones of the ratchet teeth 16. When the load has been lifted as far as desired, release lever 135 on handle H is actuated in order to release the pressure in the hydraulic cylinder, and the lift arms 130 will drop down, leaving the load supported solely by the two pawls 20 engaging respective ratchet teeth 16 on respective sides of shaft 14. The power unit can then be disengaged from the jack stand, leaving the load mechanically supported solely by the jack stand.

When the load is to be lowered, an entirely different action occurs. Control lever 140 may first be placed in the lowermost notch 142 while the power unit is being aligned with and locked to the jack stand. Then the operator pulls the control lever rearwardly and allows it to rest in the next notch, 143. At this time the lateral edges 182 of flippers 180 are pressing horizontally against the respective release arms 28. The pawls 20 do not then release, however, because the configuration of the teeth 16 and 24 and the weight of the vertical load on the shaft 14 combine to prevent the disengagement of the pawls. The position of the pawls is then as shown in FIG. 8 but the position of the flippers is as shown in FIG. 9. It will be noted that at this time the force of flippers 180 on the release arms 28 is determined by the extent to which the effective strength of springs 158 exceeds the effective strength of springs 34, taking into account the associated lever mechanisms. The next step is to utilize the pump handle H and cylinder C to raise the lift arms 130 at least a slight amount. This action relieves the vertical load on the teeth, so that the flipper springs 158 overpower the pawl springs 34, thereby permitting the pawl teeth to disengage from the ratchet teeth. The operator then pulls the release lever 135. The arms 130 then drop down, allowing the load to be lowered. It is preferred to utilize a flow restrictor in the circuit of the hydraulic cylinder C so that the arms 130 will drop slowly, at a controlled rate.

LATCHING THE JACK STANDS IN SERIES; AND AUTOMATIC DISCONNECT

Another novel feature of jack stand J, representing an invention which is separate and distinct from the novel features described above, is that each jack stand has a latch arm 60 extending longitudinally from each of its ends. The latch arm 60 at its rearward end is equipped with a release arm 65 which projects angularly outwardly a small distance from one side of the jack stand, and is normally retained in place by a coil spring 67. If the release arm 65 is pressed laterally inwardly against the spring force, latch arm 60 then swings laterally outwardly in the opposite direction.

As best seen in FIG. 15, when two of the jack stands J are placed adjacent to each other in a longitudinal series the latch arm 60 on the front end of one jack stand becomes hookingly engaged with the latch arm 60 on the rearward end of the other jack stand. However, a pivotal inward movement of one of the release arms 65 will cause the two latches to become disengaged, thus permitting the two jack stands to be separated. See FIG. 16.

The release arms 65 become operative in only one particular step of the operating procedures. When a first jack stand is being picked up by the power unit, the shoe extensions of the power unit are simply moved past the opposing sides of the jack stand, above bottom plate 10 but below side rails 40, until alignment pins 175 lock into the respective alignment holes 48. See FIG. 17. If a second jack stand is to be picked up for transport, the operator then moves the control lever 140 into its full disengagement position at upper edge 144 of opening 140 (see FIGS. 4, 10, and 13). Using handle H, the operator then pushes the power unit further forward so that the shoe extensions can pick up the next jack stand; again, by entering the vertical space between bottom plate 10 and side rails 40. The power unit is pushed forward until alignment pins 175 lock with the holes 48 in the second jack stand.

When two jack stands are thus being transported on and by the power unit, the forward one of the jack stands is necessarily the one that will be positioned first for lifting a load. The lifting action, and the method of then disengaging the power unit from the raised and loaded stand, have been previously described.

When the power unit is to be disengaged from the forward stand, that is accomplished by the operator by pulling the handle H rearwardly. It is at this time that the latch release arm 65 on one of the jack stands cooperates with a tripper 200 on the power unit for unlatching the two stands.

The power unit P is equipped with a single tripper device 200, located on the right-hand side of frame 100 as viewed from above. It has a rounded corner adapted for engagement by the release arm 65. See FIG. 6. Longitudinal movement of the power unit frame in the reverse direction relative to the two jack stands causes the release arm 65 on one of the stands to be pivoted laterally inwardly in the horizontal plane, thus causing the associated latch arm 60 to pivot laterally outwardly, and detaching that jack stand from the other jack stand in front of it. See FIG. 16. In FIG. 16 the arrow 85 indicates the direction of movement of power unit P relative to both of the jack stands J.

Figure 6:
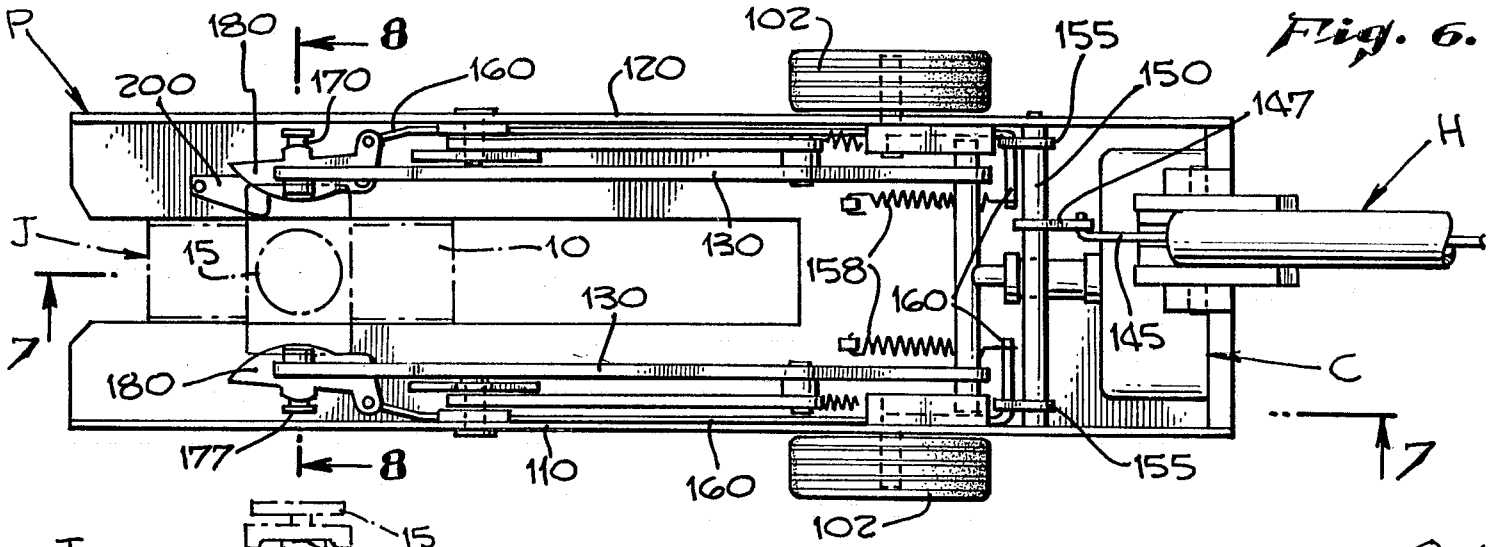
FIG. 6 is a top plan view of the forward or shoe portion of the power unit, also showing a portion of its handle, and showing in dotted lines the operative position of a jack stand.
Figure 7:
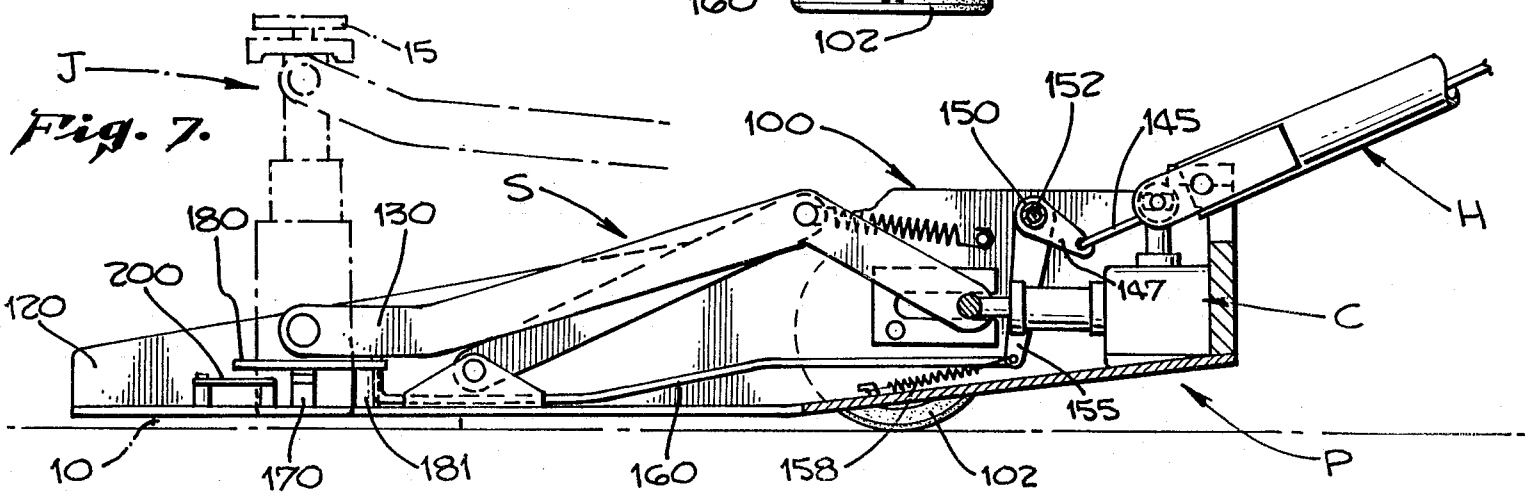
FIG. 7 is a side elevation view taken on the line 7—7 of FIG. 6.

It will be noted in FIGS. 11–13 that the tripper 200 is located on shoe extension 120 of the power unit P slightly forwardly of the associated flipper 180. Its position is fixed relative to the shoe extension, and it accomplishes its function not by its own movement, but by the longitudinal movement of the power unit relative to the jack stand. As seen in FIGS. 6 and FIG. 7 the tripper 200 is supported at an elevation above the horizontal part of the shoe extension, somewhat below the substantially horizontal plane occupied by the flipper 180, and also at a slightly lower elevation than the top of the alignment pin block 170.

Furthermore, the relative longitudinal separations between the operative corner of tripper 200 and the longitudinal axis of alignment pin 175 on the power unit, and the alignment hole 48 and release arm 65 on the jack stand, are of critical importance. Specifically, release arm 65 is farther from alignment hole 48 than tripper 200 is from alignment pin 175. As a result, the tripping action occurs somewhat in advance of the location where the power unit becomes locked to the second jack stand. Were it otherwise, the power unit would become locked to the second jack stand, which would still be latched to the first jack stand, and it would not be possible for the operator, by remote control from handle H, to freely move the power unit and second jack stand away from the location where the first jack stand is firm held in place, supporting a vertical load.

METHOD OF AUTOMATIC DISCONNECTION OF JACK STANDS

Thus according to the present invention a novel method of transporting plural jack stands while controlling the operation from a remote location, the outer end of handle H, includes the following steps. The jack stands are latched together in a longitudinal series and loaded upon the power unit shoe in that series. A forward one of the jack stands is controlled for lifting a vertical load. Then the power unit is detached from the forward jack stand, is pulled rearwardly, and a trip mechanism cooperating between the power unit and the second jack stand causes the second jack stand to become unlatched from the first one. Thereafter, further rearward movement of the power unit relative to the second jack stand results in its alignment with, and becoming locked to, the second jack stand.

While the jack stand J is illustrated with pivotal latch arms 60 on each of its ends, it is actually preferred to have one of those latch arms in a fixed position and to equip only the other with a release arm and spring. In that preferred arrangement, since the two ends of the jack stand are not equivalent, the jack stand must initially be picked up from a particular one of its ends by the power unit.

It is now apparent that the two end ramps 42, 44, on each side rail 40 are of some significance, since one of those ramps is used when moving the power unit forwardly to pick up a jack stand positioned in front of the power unit, and the other end ramp is used when the power unit is moved rearwardly to align and lock it to a second jack stand which it is already carrying.

The invention in its presently preferred form has been described in considerable detail in order to fully comply with the requirements of the patent laws. The scope of the invention, however, is to be measured only in accordance with the appended claims.

We claim:

1. A two-part jack system comprising:

a mechanical jack stand including a vertical ratchet engageable by a spring-loaded pawl having a release arm;

a power unit having a frame portion and an operating handle, said frame portion being alignable with said jack stand;

a ratchet release member carried by said power unit frame and selectively engageable with said release arm;

a spring-loaded pin carried by said power unit said jack stand having a hole for receiving said pin to thereby establish and maintain a condition of alignment; and a unitary control means carried by said power unit, including a control lever on said power unit handle, and means coupling said control lever to both said ratchet release member and said pin and adapted to selectively (a) retain said pin in said hole while concurrently holding said ratchet release member in disengagement; or (b) retain said ratchet release member in engagement with said arm while concurrently retaining said pin in said hole; or (c) hold both said pin and said ratchet release member in positions of disengagement.

2. A two-part jack system comprising:

a power unit including a frame having a shoe with a parallel pair of forward extensions, a scissors mechanism carried by said forward extensions, a parallel pair of lifting arms in said scissors, and a handle extending rearwardly from said frame;

at least one extendible jack stand having a hollow lower frame member, a base plate attached to the lowermost end of said lower frame member, an upper frame member in the form of a toothed shaft arranged in telescoping relation to said lower frame member, and a spring-loaded pawl carried by said lower frame member and adapted to support said upper frame member in selected positions of upward extension;

said power unit also including a pair of inwardly biased, spring-loaded ratchet release members and a pair of inwardly extending, spring-loaded locking pins, each carried by respective ones of said shoe extensions;

said jack stand further including a pair of parallel, horizontally extending side rails attached to opposite sides of said lower frame member, an outwardly opening horizontal alignment hole near the longitudinal center of each of said side rails, and said side rails having vertical outer surfaces which are tapered inwardly at their ends to provide alignment ramps; and said power unit further having an operating lever on said handle, and control means coupling said operating lever to both of said ratchet release members and both of said locking pins in order to control the attachment of the power unit to a jack stand, the release or non-release of the jack stand pawl, and the detachment of the power unit from the jack stand.

3. In a two-part jack system comprising a power unit having a shoe with a parallel pair of forward extensions, and at least one extendible jack stand having a hollow lower frame member and a spring-loaded pawl carried by said lower frame member which is adapted to support an upper frame member in selected positions of upward extension, control mechanisms comprising:

a pair of inwardly biased, spring-loaded ratchet release members and a pair of inwardly extending, spring-loaded locking pins, each carried by respective ones of said shoe extensions of said power unit; and a pair of parallel, horizontally extending side rails attached to opposite sides of said lower frame member of said jack stand, each of said side rails having vertical outer surfaces with an outwardly opening horizontal alignment hole near the longitudinal center thereof, said side rails also being tapered inwardly at their ends to provide alignment ramps;

said alignment holes of said jack stand being adapted to received said locking pins of said power unit, and said ratchet release members of said power unit being adapted to cooperate with said pawl of said jack stand.

4. In a two-part jack system including a mechanical jack stand with a ratchet mechanism and a ratchet release, and a power unit having an operating handle, the power unit being adapted to be selectively aligned with and attached to the jack stand for raising or lowering it, the improvement comprising:

the power unit having locking means for locking the power unit in aligned relationship to the jack stand, and release means for releasing the ratchet release of the jack stand when the jack stand is to be lowered;

unitary control means carried by the power unit handle, including an operating lever;

means coupling said operating lever to both said locking means and said release means; and said operating lever having a first operating position in which said locking means is kept locked and said release means keeps said ratchet release in an unreleased condition, a second operating position in which said locking means is kept locked but said release means releases said ratchet release, and a third operating position in which said locking means is kept unlocked and said release means keeps said ratchet release in an unreleased state.

5. In a two-part jack system comprising a power unit having a shoe with a parallel pair of forward extensions, and at least one extendible jack stand having a lower frame member and a spring-loaded pawl carried by said lower frame member which is adapted to support an upper frame member in selected positions of upward extension, the improvements comprising:

said jack stand having a pair of parallel, horizontally extending side rails attached to opposite sides of said lower frame member, each of said side rails having a vertical outer surface with an outwardly opening horizontal alignment hole near the longitudinal center thereof;

said side rails of said jack stand also being tapered inwardly at their ends to provide alignment ramps, each shoe extension of said power unit carrying an inwardly extending, spring-loaded locking pin, and said alignment holes of said jack stand rails being adapted to receive said locking pins of said power unit;

each of said shoe extensions of said power unit also carrying an inwardly biased, spring-loaded ratchet release member; and said ratchet release members of said power unit being adapted to cooperate with said pawl of said jack stand for releasing the support of said upper frame member.

* * * * *